United States Patent [19]

Belpaume

[11] 4,103,360

[45] Aug. 1, 1978

[54] WOMAN'S GARMENT WHICH MOLDS THE UPPER BODY

[75] Inventor: Charles Belpaume, Bouc Bel Air, France

[73] Assignee: Baron Chalmalla SA, Fribourg, Switzerland

[21] Appl. No.: 810,275

[22] Filed: Jun. 27, 1977

[30] Foreign Application Priority Data

Jun. 25, 1976 [FR] France ..... 76 19315

[51] Int. Cl.[2] ..... A41D 5/00

[52] U.S. Cl. ..... 2/67

[58] Field of Search ..... 2/67, 73, 72, 115; 128/531

[56] References Cited

U.S. PATENT DOCUMENTS 3,436,762 4/1969 Cohan ..... 2/67

FOREIGN PATENT DOCUMENTS 2,541,297 3/1977 Fed. Rep. of Germany ..... 2/67

*Primary Examiner*—Doris L. Troutman

*Attorney, Agent, or Firm*—Keil, Thompson & Shurtleff

[57] ABSTRACT

A woman's garment having seams which extend continuously from its upper edge to its lower edge to mould the upper body, said garment being characterized in that it has two lateral seams symmetrical in relation to the vertical plane of symmetry of the body, each seam following, downwardly, a path such that it crosses the breast, while passing substantially over the nipple region and while forming by a first contour a housing for the breast, and such that it crosses the side in order to be directed downwards and outwards towards the iliac crest then downwards and backwards to the level of the sacral promontory, and finally such that it crosses the gluteal muscles to extend at least as far as the gluteal fold while forming by a second contour, a housing for the buttock.

The garment is one which moulds the upper body such as a one-piece bathing costume, an all-body tight garment, a leotard, or a blouse of the type closing between the legs.

5 Claims, 6 Drawing Figures

WOMAN'S GARMENT WHICH MOLDS THE UPPER BODY

BACKGROUND OF THE INVENTION

The present invention relates to a woman's garment, and more particularly to a garment which moulds the upper body such as a one-piece bathing costume, an all-body tight garment, a leotard, a blouse of the type closing between the legs.

There are already known women's garments, for example one-piece bathing costumes, having one and preferably several seams which extend continuously from their upper to their lower edge. These seams are most often positioned in the vertical plane of symmetry of the body, at the back or in front of the chest, or on the side level with the armpits.

These seams are essentially intended to form the various panels of fabric during the making-up of the garments. On the other hand they have no function in supporting the bust or holding the buttocks and it is often necessary to reinforce the garment.

The object of the present invention is to lessen this disadvantage and to that end it relates to a woman's garment including seams which at the same time provide support for the bust and hold the buttocks.

The invention therefore has as its object the new industrial product which is a woman's garment having seams extending continuously from its upper edge to its lower edge, characterised in that it includes two lateral seams, symmetrical relative to the vertical plane of symmetry of the body, each seam following in a downward direction a path such that it crosses the breast, while passing substantially over the nipple region, and while forming by a first contour a housing for the breast, and such that it crosses the side in order to be directed downwards and outwards towards the iliac crest then downwards and backwards to the level of the sacral promontory, and finally such that it crosses the gluteal muscles to extend at least as far as the gluteal fold while forming by a second contour, a housing for the buttock.

It can therefore be seen that each lateral seam has the function of forming in its upper part, by its first contour, a housing for the breast and in its lower part by its second contour, a housing for the buttock. On each side the two housings are interdependent since both are formed into a single piece by a common lateral seam. The four housings made by the two contours of each seam allow an enclosure of the breasts and the buttocks, that is to say a moulding of these parts without crushing or flattening. The garment of the invention allows the support, holding and enclosure of the bosom and the buttocks thanks to the said housings, while avoiding any undue compression of those parts.

In the preferred modes of carrying out the invention each lateral seam passes over the superior lateral radix of the breast while extending as far as the nipple region; each lateral seam starts substantially at the level of the axillary extension of the breast, then slants downwards and inwards along a substantially straight path passing over the nipple region; each lateral seam, after the sacral promontory, takes up a curve of anterior concavity crossing the gluteal muscles, the same seam ending at the level of the gluteal fold at the junction of the lateral face and posterior face of the thigh; the path of each lateral seam is, after the nipple region, that of a curve of anterior-medial convexity of which the radius of curvature increases as it goes down, then, substantially from the iliac crest, that of a posterior medial convexity curve of which the radius of curvature decreases as it goes downwardly as far as the level of the sacral promontory.

In order to make it easier to understand the object of the present invention, we are now going to describe, by way of illustrative not limitative example, one form of embodiment of the present invention with reference to the attached drawing in which.

Figure 1:
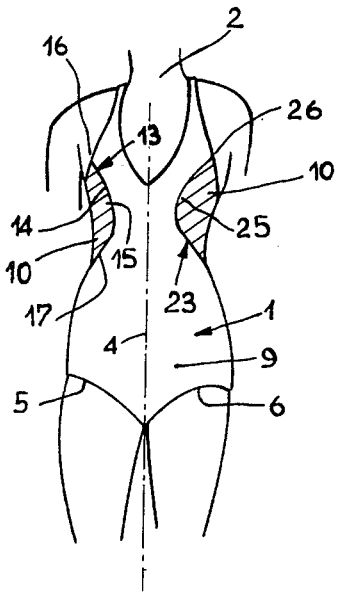
FIG. 1 is a front view of the costume being worn.

Referring to the drawing, it is seen that 1 designates the complete woman's garment, of the one-piece bathing costume type, worn by a woman 2.

This garment is formed by the making-up from any textiles generally used for garments which mould the body, which can be got either from a single-material fibre, or from a combination of several animal, vegetable, synthetic or artificial fibres, usually with a certain elasticity.

The garment has two lateral seams 13 and 23 symmetrical relative to the vertical plane of symmetry 4 of the body 2.

Each lateral seam follows from top to bottom a path such that it passes over the superior lateral radix 14, 24 of the breast, then over the nipple region 15, 25, respectively.

Figure 2:
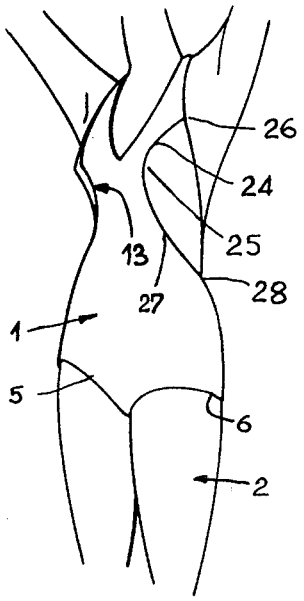
FIGS. 2 and 3 are three-quarter front views of the garment of FIG. 1.
Figure 3:
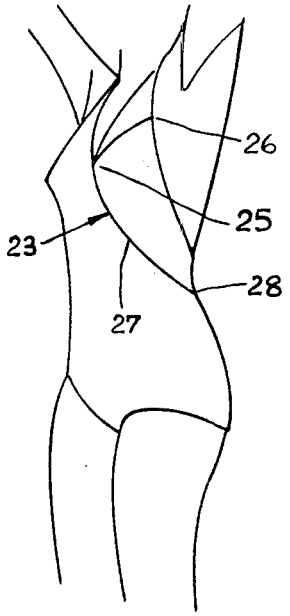
Figure 4:
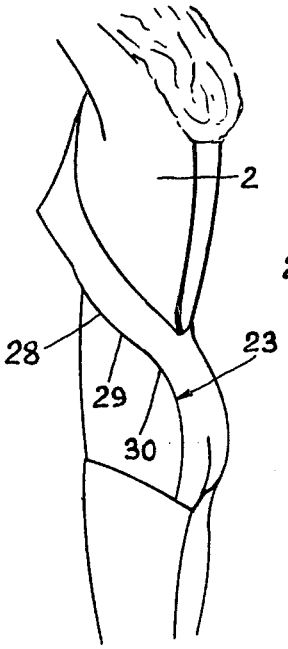
FIGS. 4 and 5 are three-quarter rear views of the garment of FIG. 1.
Figure 5:
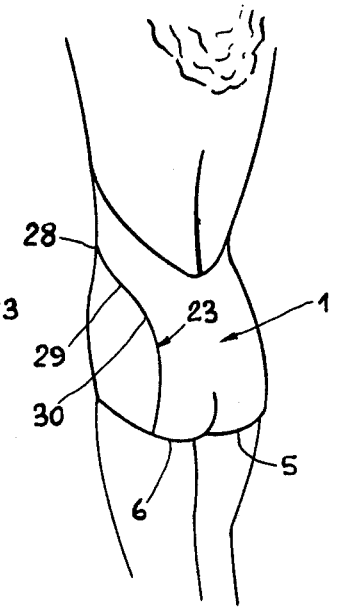
Figure 6:
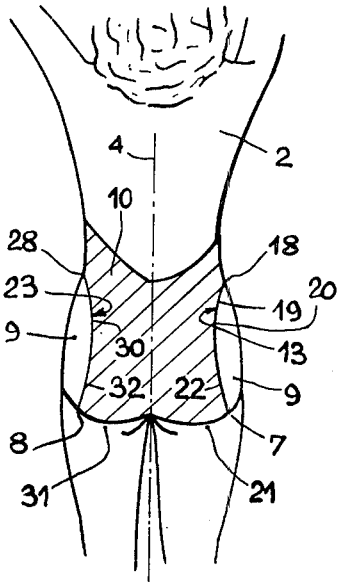
FIG. 6 is a rear view of the garment according to the invention

Taking for example the bathing costume in FIGS. 1 to 6, each lateral seam starts substantially at the level of the axillary extension 16, 26 of the breast, then slants downwards and inwards along a substantially straight path going over the nipple region.

In this region, each lateral seam is rounded at a very small radius of curvature, in such a way that it goes over the side in order to go downwards and outwards, along the segment 17, 27 respectively, towards the iliac crest 18, 28, respectively.

The path of each segment 17, 27 of the lateral seams is, between the nipple region 15, 25 and the iliac crest 18, 28 that of a curve of anterior-medial convexity of which the radius of curvature increases as it goes down.

From the iliac crest, each lateral seam crosses below and behind, following the path of a curve of posterior medial convexity 19, 29 respectively, of which the radius of curvature decreases as it goes downwardly as far as the level of the sacral promontory 20, 30.

Beyond the sacral promontory, each seam crosses the gluteal muscles to reach as far as the gluteal fold, 21, 31 respectively.

When the garment is a swimming costume it usually ends at two leg holes 5, 6 arranged at the rear below the buttocks respectively to allow them to be entirely enclosed. Thus the leg holes of the costume cover over at the back, the gluteal fold 21, 31. In front, and to be more exact, at the level of anterior lateral radix of each thigh, each leg hole can be cut back so that it leaves the groin and inguinal fold free.

In the back, after the sacral promontory, each seam 13, 23 takes up a curve of anterior concavity crossing the gluteal muscles, the said curve having a radius of curvature substantially increasing downwardly and becoming practically straight and slightly inclined laterally from the vertical, as it goes downwards, in its final buttock-covering segment 22, 32.

At the level of the gluteal fold, each seam passes substantially to the junction 7, 8 of the lateral face and the posterior face of the thigh in order to end at that point, on the gluteal fold, in the example seen in the attached drawings.

It can therefore be seen that on each side of the plane of symmetry 4, the lateral seam 13, 23 respectively has a dual role; at its upper end it supports the bust passing over the superior lateral radix of the breast before crossing the side; at its lower end it holds the buttocks in place, crossing from the iliac crest to the level of the sacral promontory before being prolonged as far as the gluteal fold at the junction of the lateral face and the posterior face of the thigh.

The upper portion and the lower portion of each seam being united as they cross the side, it is obvious that the garment according to the invention may be made up of only two panels: a front panel 9 and a back panel 10 united from top to bottom by the two lateral seams so as to form a sort of sleeve making up the garment.

In this case, naturally, the front panel and the back panel are sewn one to the other at their bottom part at the level of the crutch.

Each lateral seam, from top to bottom, extends successively over the front, over the side, then over the back of the costume. This particular arrangement thus gives an original characteristic which lends itself to aesthetic exploitation, for example by making up the front and rear panels in different colours. This characteristic is moreover, diagrammatically shown in FIGS. 1 and 6, the front panel 9 being for example light in colour and the back panel 10 being for example dark in colour, as appears from the hatched areas.

Of course, the invention is not limited to the mode of application or even to the mode of embodiment which have been described, and different variations could be envisaged without thereby going beyond the framework of the invention. In particular the invention is applicable to all women's garments made to mould the upper body, such as all-body-tight garments, leotards, combinations, body-stockings, and it is under no circumstances limited to the swimming costume of the attached drawing which is only given to illustrate the invention and to help it to be understood.

I claim:

1. Woman's garment, and more particularly a garment which moulds the upper body such as a one-piece bathing costume, an all-body-tight garment, a leotard, a blouse of the type closing between the legs, the said garment having seams which extend continuously from its upper edge to its lower edge characterised in that it has two lateral seams symmetrical in relation to the vertical plane of symmetry of the body, and each seam following, downwardly, a path such that it crosses the breast while passing substantially over the nipple region and while forming by a first contour a housing for the breast, and such that it crosses the side in order to be directed downwards and outwards towards the iliac crest then downwards and backwards to the level of the sacral promontory, and finally such that it crosses the gluteal muscles to extend at least as far as the gluteal fold while forming by a second contour, a housing for the buttock.

2. Garment according to claim 1 characterised in that each lateral seam goes over the superior lateral radix of the breast while extending as far as the nipple region.

3. Garment according to claim 2 characterised in that each lateral seam starts substantially at the level of the axillary extension of the breast, then slants downwards and inwards along a substantially straight path going over the nipple region.

4. Garment according to claim 1 characterised in that each lateral seam, beyond the sacral promontory, takes up a curve of anterior concavity crossing the gluteal muscles, the said seam ending at the level of the gluteal fold at the junction of the lateral face and the posterior face of the thigh.

5. Garment according to claim 1 characterised in that the path of each lateral seam is, beyond the nipple region, that of a curve of anterior medial convexity of which the radius of curvature increases downwardly, then, substantially from the iliac crest, that of a curve of posterior medial convexity of which the radius of curvature decreases downwardly as far as the level of the sacral promontory.

* * * * *